US009119486B2

(12) United States Patent
Reed

(10) Patent No.: US 9,119,486 B2
(45) Date of Patent: Sep. 1, 2015

(54) PEDESTALS

(71) Applicant: Petra Reed, Boise, ID (US)

(72) Inventor: Petra Reed, Boise, ID (US)

(73) Assignee: PEDESTAL DESIGNS, INC., Boise, ID (US)

( * ) Notice: Subject to any disclaimer, the term of this patent is extended or adjusted under 35 U.S.C. 154(b) by 96 days.

(21) Appl. No.: 14/010,187

(22) Filed: Aug. 26, 2013

(65) Prior Publication Data

US 2014/0054253 A1 Feb. 27, 2014

Related U.S. Application Data

(60) Provisional application No. 61/693,045, filed on Aug. 24, 2012.

(51) Int. Cl.

| | |
|---|---|
| ***A47B 57/00*** | (2006.01) |
| ***A47F 5/00*** | (2006.01) |
| ***A47F 5/16*** | (2006.01) |
| ***A47B 87/02*** | (2006.01) |
| ***A47G 19/00*** | (2006.01) |

(52) U.S. Cl.

CPC ..... *A47F 5/0043* (2013.01); *A47B 87/0246* (2013.01); *A47F 5/0018* (2013.01); *A47F 5/16* (2013.01); *A47G 19/00* (2013.01)

(58) Field of Classification Search

CPC ..... A47B 13/023; A47B 13/02; A47B 13/06; A47B 13/08; A47B 3/06; A47B 3/12; A47B 13/003; A47B 11/00; A47B 91/00; A47B 87/0246; A47B 91/005

USPC ..... 248/346.01, 678, 349.1, 415, 188.1; 446/117, 128, 122, 124, 476; 403/361, 403/364; 108/150, 92, 93, 101, 180, 186, 108/191; 312/107, 111

See application file for complete search history.

(56) References Cited

U.S. PATENT DOCUMENTS

| | | | | |
|---|---|---|---|---|
| 198,050 | A | | 12/1877 | Scott |
| 243,567 | A | | 6/1881 | Ireland |
| 283,090 | A | | 8/1883 | Farnum |
| 554,661 | A | | 2/1896 | Dolittle |
| 1,213,690 | A | | 1/1917 | Quinones |
| 1,298,762 | A | | 4/1919 | Milligan |
| 1,331,862 | A | * | 2/1920 | Claus ..... 206/511 |
| 1,437,867 | A | | 12/1922 | Sixta |
| 1,443,420 | A | | 1/1923 | Lennox |
| 1,870,005 | A | * | 8/1932 | Gutsch ..... 312/107 |
| 2,023,300 | A | | 12/1935 | Barnett |
| 2,119,821 | A | | 6/1938 | Manley |
| D118,463 | S | | 1/1940 | West |
| 2,204,319 | A | | 6/1940 | Parsons et al. |
| 2,239,156 | A | | 4/1941 | Lewis |
| 2,377,904 | A | | 6/1945 | Roach |
| 2,692,107 | A | | 10/1954 | De Ridder et al. |
| 2,696,356 | A | | 12/1954 | Baumann |
| 2,883,764 | A | | 4/1959 | Stephens |

(Continued)

*Primary Examiner* — Janet M Wilkens

(74) *Attorney, Agent, or Firm* — Pedersen and Company, PLLC; Ken J. Pedersen; Barbara S. Pedersen

(57) ABSTRACT

Display pedestals comprise at least one generally planar horizontal support member which is hollow, and at least one vertical column. The top surface and/or the bottom surface of the support member has least one depression or at least one projection, and at least one vertical column fits to the depression or projection. The interior volume of the hollow support member is filled with air or with a foamed polymeric or metallic material.

13 Claims, 5 Drawing Sheets

(56) References Cited

U.S. PATENT DOCUMENTS

| | | | | | |
|---|---|---|---|---|---|
| 3,091,361 | A | * | 5/1963 | Gawron | 206/508 |
| 3,131,656 | A | | 5/1964 | Houle | |
| 3,161,986 | A | | 12/1964 | Stubbmann et al. | |
| 3,176,676 | A | | 4/1965 | Caldwell | |
| 3,538,862 | A | | 11/1970 | Patriarca | |
| D221,781 | S | | 9/1971 | Caigan | |
| 3,654,877 | A | | 4/1972 | Barrett | |
| 3,736,714 | A | * | 6/1973 | Brenner | 52/300 |
| 3,741,404 | A | * | 6/1973 | Jourdain | 108/91 |
| 3,756,169 | A | * | 9/1973 | Dybvig | 108/150 |
| 3,858,495 | A | | 1/1975 | Gotwalt | |
| 3,878,796 | A | | 4/1975 | Morrison | |
| 3,942,654 | A | | 3/1976 | Warrick | |
| 4,147,007 | A | | 4/1979 | Eppich | |
| 4,169,417 | A | | 10/1979 | Gemvik | |
| 4,220,099 | A | | 9/1980 | Marchesano | |
| 4,397,246 | A | | 8/1983 | Ishida et al. | |
| 4,424,753 | A | | 1/1984 | Eatherton | |
| 4,511,034 | A | * | 4/1985 | Pan | 206/310 |
| D287,677 | S | | 1/1987 | Pomeroy et al. | |
| 4,760,802 | A | * | 8/1988 | Leong | 108/157.16 |
| 4,761,930 | A | | 8/1988 | Tepera | |
| 4,781,643 | A | * | 11/1988 | Holloway et al. | 446/75 |
| 4,841,879 | A | | 6/1989 | Ferguson | |
| 4,841,880 | A | | 6/1989 | Ferguson | |
| 4,955,490 | A | | 9/1990 | Schafer | |
| D321,101 | S | | 10/1991 | Zucker | |
| 5,101,737 | A | | 4/1992 | Gomez | |
| D328,536 | S | | 8/1992 | Ma | |
| 5,269,231 | A | | 12/1993 | Johnson | |
| 5,272,990 | A | | 12/1993 | Carter | |
| 5,353,716 | A | | 10/1994 | Wilbert | |
| 5,425,198 | A | | 6/1995 | Coy | |
| 5,425,314 | A | | 6/1995 | MacFarland | |
| 5,440,998 | A | | 8/1995 | Morgan et al. | |
| 5,487,345 | A | | 1/1996 | Winebarger et al. | |
| 5,537,937 | A | | 7/1996 | Juvik-Woods | |
| 5,577,344 | A | * | 11/1996 | Zaremba et al. | 47/39 |
| 5,662,048 | A | | 9/1997 | Kralj et al. | |
| 5,676,251 | A | * | 10/1997 | Credle, Jr. | 206/501 |
| 5,687,653 | A | | 11/1997 | Bumgarner | |
| 5,718,178 | A | * | 2/1998 | Smith | 108/25 |
| 5,785,530 | A | * | 7/1998 | Smith | 434/219 |
| 5,829,602 | A | | 11/1998 | St. John Danko | |
| 5,830,032 | A | * | 11/1998 | Campbell | 446/128 |
| 5,842,425 | A | | 12/1998 | Van Der Aa | |
| 5,887,513 | A | | 3/1999 | Fielding et al. | |
| 5,967,056 | A | | 10/1999 | Plante | |
| 5,971,830 | A | | 10/1999 | Tobin | |
| 5,996,819 | A | | 12/1999 | Klein | |
| 5,996,820 | A | | 12/1999 | Broadnax | |
| 6,039,192 | A | | 3/2000 | Hollander | |
| 6,041,719 | A | | 3/2000 | Vidal et al. | |
| 6,158,360 | A | | 12/2000 | Cheng | |
| 6,182,841 | B1 | | 2/2001 | Klein | |
| D446,043 | S | | 8/2001 | Stoppenhagen et al. | |
| 6,314,869 | B1 | | 11/2001 | Bourgeois | |
| D453,372 | S | | 2/2002 | Pecoskie | |
| 6,345,466 | B1 | * | 2/2002 | Venanzi | 47/66.1 |
| 6,360,884 | B1 | * | 3/2002 | Smith et al. | 206/209.1 |
| 6,505,804 | B1 | | 1/2003 | Francis et al. | |
| 6,688,573 | B2 | | 2/2004 | Reed et al. | |
| 6,877,442 | B2 | | 4/2005 | Helle | |
| 6,915,994 | B2 | | 7/2005 | Oddsen | |
| 6,938,558 | B1 | | 9/2005 | Peres | |
| 7,399,090 | B2 | * | 7/2008 | Oda | 353/119 |
| 7,407,144 | B2 | | 8/2008 | Reed et al. | |
| 7,490,561 | B1 | | 2/2009 | Chou | |
| 7,856,933 | B2 | | 12/2010 | Miller et al. | |
| 7,922,492 | B2 | * | 4/2011 | Nielsen et al. | 434/80 |
| 8,127,696 | B2 | | 3/2012 | Reed et al. | |
| 8,286,563 | B2 | | 10/2012 | Low | |
| 2003/0007321 | A1 | * | 1/2003 | Dayley | 361/683 |
| 2003/0104098 | A1 | * | 6/2003 | Schrader | 425/522 |
| 2004/0164653 | A1 | * | 8/2004 | Winkless | 312/107 |
| 2004/0226490 | A1 | | 11/2004 | Polumbaum | |
| 2004/0226492 | A1 | * | 11/2004 | Carter | 108/158.12 |
| 2005/0081764 | A1 | | 4/2005 | Michaels et al. | |
| 2005/0166804 | A1 | | 8/2005 | Hansen | |
| 2006/0096508 | A1 | | 5/2006 | Herring | |
| 2007/0228244 | A1 | * | 10/2007 | Reed | 248/349.1 |
| 2008/0011206 | A1 | * | 1/2008 | Warriner | 108/150 |
| 2008/0066657 | A1 | | 3/2008 | Kuo | |
| 2008/0163801 | A1 | * | 7/2008 | Gamba et al. | 108/102 |
| 2012/0160138 | A1 | | 6/2012 | Reed et al. | |

* cited by examiner

PEDESTALS

CROSS-REFERENCE TO RELATED APPLICATIONS

This application claims priority from, and the benefit of, provisional application No. 61/693,045 filed Aug. 24, 2012, the entire contents of which are incorporated herein by reference.

This application is related to (1) U.S. Pat. No. 6,688,573, (2) U.S. Pat. No. 7,407,144, (3) U.S. Pat. No. 7,673,843 and (4) U.S. Pat. No. 7,722,005. The entire content of each of those patents is incorporated herein by reference for all purposes.

BACKGROUND OF THE INVENTION

This invention relates to pedestals. The term "pedestal" is used herein to denote a structure which can be placed on a surface, often a horizontal surface, for example on the earth, on the floor of a building, or on an elevated surface (for example a buffet or other table, sideboard, desk or the floor of a shop window) and which will support objects (e.g. tableware of all kinds, foodstuffs for consumption, jewelry, merchandise for sale, and other objects being displayed for commercial and/or aesthetic purposes) placed on top of, or at intermediate levels of, the pedestal. For example, pedestals are widely used in the catering and hospitality industry to support serving dishes, containers, platters, trays, jugs, glasses, bottles, cutlery, ice sculptures and flower vases at positions chosen for functional, e.g. sale of merchandise, and/or decorative reasons.

SUMMARY OF THE INVENTION

The pedestals referred to in this specification comprise one or more generally vertical components, referred to herein as "columns", and one or more generally horizontal components, referred to herein as "supports" or "support members". The term "vertical axis" is used herein in relation to a column to denote a vertical line which passes through the center of gravity of the column. The references herein to vertical, horizontal, top, bottom, upper and lower assume that the pedestal is being used normally. However, the invention includes the possibility that the pedestal is in a different orientation, and the terms vertical and horizontal are used to include variations from the strictly vertical and strictly horizontal directions which do not have any substantial effect on the function of the components in question.

As the supports in a pedestal become wider and/or longer and/or thicker, they become heavier, and, therefore, more difficult to handle. This invention provides a solution to this problem by making use of a support which is effectively "hollow" in that some or all of its interior volume is filled with air or another lightweight material, for example a foamed polymeric or metallic material, which may be a recycled material. The interior volume can also comprise reinforcing ribs which are connected between opposite parts of the periphery, and which may form a grid.

I have discovered, in accordance with the present invention, novel pedestals; novel pedestal components which can be assembled, optionally with known pedestal components, into novel pedestals; novel kits containing pedestal components; novel methods for making pedestals; and novel methods of displaying objects on pedestals.

In a first preferred aspect, this invention provides a substantially planar horizontal support which comprises (1) an upper member which has a substantially continuous planar upper surface, (2) a lower member which has a substantially continuous planar lower surface, and (3) a substantially continuous peripheral member which secures the upper and lower members together, the upper and lower members and the peripheral member defining between them a volume which extends over at least part of the area defined by the periphery of the support, and whose density is substantially smaller than the density of the upper and lower members, and at least one of the upper and lower surfaces comprising a conformation which is selected from the group consisting of (i) depressions which extend inwards from the upper surface or the lower surface but at least part of which does not extend through to the opposite surface and (ii) projections which extend outwards from the upper surface or the lower surface;

In a second preferred aspect, this invention provides a pedestal which comprises (1) a horizontal support according to the first preferred aspect of the invention, and (2) a vertical column which fits into the depression in the horizontal support or which fits over the projection extending from the horizontal support.

The pedestal can comprise, in addition to one or more horizontal supports according to the first preferred aspect of the invention and one or more vertical columns which fit into a depression or fit over a projection on a horizontal support of the first aspect of the invention, one or more additional horizontal supports which are not horizontal supports according to the first aspect of the invention and one or more additional columns which do not fit into a depression or over a projection on a horizontal support according to the first aspect of the invention. The additional horizontal supports may comprise one or more depressions and/or projections to which the additional vertical columns are fitted.

In some pedestals of the invention, the components of the pedestal are secured together only by gravitational forces (optionally including gravitational forces resulting from the objects on the pedestal). In other embodiments, at least some of the components of the pedestal are secured together with the aid of clips, preferably removable clips.

In a third preferred aspect, this invention provides a kit containing components for assembling one or more pedestals of the second aspect of the invention. The components of a kit can be packed into any suitable container, optionally having compartments for different components, for example a compartmented cart having wheels, a box or a bag, e.g. a cardboard box or a fabric bag.

In a fourth preferred aspect, this invention provides a method of making a pedestal according to the second aspect of the invention, which comprises assembling at least one column and at least one horizontal support according to the first aspect of the invention so that they are secured to each other. In one embodiment, the components of the pedestal are assembled by the use of manual forces only (i.e. without the use of tools). In another embodiment the components of the pedestal are assembled using tools which may or may not form part of the completed pedestal.

In a fifth preferred aspect, this invention provides a method of displaying objects which comprises placing the objects on a pedestal according to the first aspect of the invention.

BRIEF DESCRIPTION OF THE DRAWINGS

The invention is illustrated by the accompanying drawings, which are diagrammatic and not to scale, and in which.

DETAILED DESCRIPTION OF THE INVENTION

Figure 1:
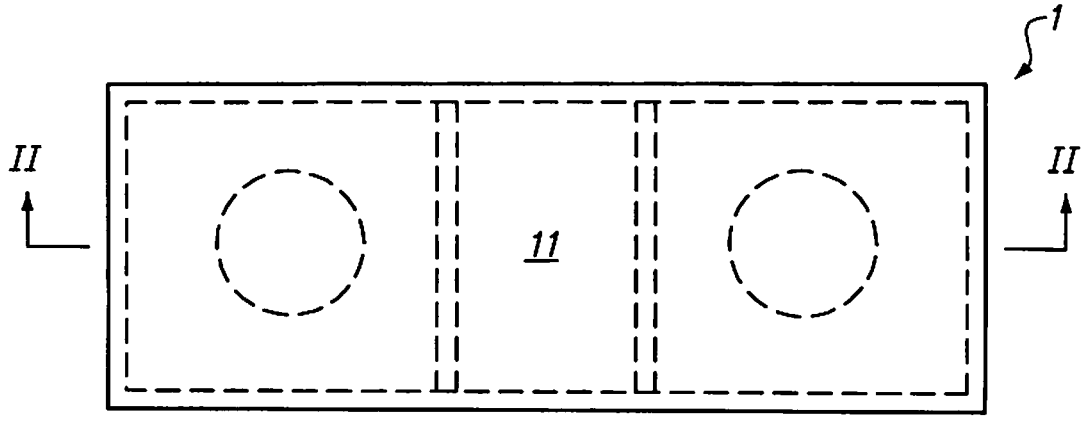
FIG. 1 is a plan view of a horizontal support of the invention.

In the Summary of the Invention above, and in the Detailed Description of the Invention, and in the accompanying drawings, reference is made to particular features of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally.

The term "comprises" and grammatical equivalents thereof are used herein to mean that other elements (i.e. components, ingredients, steps etc.) are optionally present. For example, a pedestal "comprising" (or "which comprises") components A, B and C can contain only components A, B and C, or can contain not only components A, B and C but also one or more other components. The term "at least" followed by a number is used herein to denote the start of a range beginning with that number (which may be a range having an upper limit or no upper limit, depending on the variable being defined). For example "at least 1" means 1 or more than 1. When, in this specification, a range is given as "(a first number) to (a second number)" or "(a first number)-(a second number)", this means a range whose lower limit is the first number and whose upper limit is the second number. For example, "from 0.2 to 5 inches" or "0.2-5 inches" means a range whose lower limit is 0.2 inches, and whose upper limit is 5 inches. The terms "plural" and "plurality" are used herein to denote two or more than two items.

Where reference is made herein to "first" and "second" elements, this is often done for identification purposes; unless the context requires otherwise, the first and second elements can be the same or different, and reference to a first element does not mean that a second element is necessarily present (though it may be present). Where reference is made herein to "a" or "an" element, this includes the possibility that there are two or more such elements (except where the context excludes that possibility). Where reference is made herein to two or more elements, this includes the possibility that the two or more elements are replaced by a lesser number or greater number of elements providing the same function (except where the context excludes that possibility). The numbers given herein should be construed with the latitude appropriate to their context and expression; for example, each number is subject to variation which depends on the accuracy with which it can be measured by methods conventionally used by those skilled in the art.

First Aspect of the Invention

The horizontal support of the first aspect of the invention can be of any size and shape which enables the support to provide desired functions in a pedestal. For example, it can have one or more of (i.e. any possible combination of two or more of) the following optional characteristics.

(1) In plan view, the support has a shape which is rectangular (including square), rectangular with rounded corners, polygonal, circular, oval or other regularly curved shape.

(2) The upper member has a planar upper surface which is free from depressions and projections, and the lower member has a substantially planar lower surface which comprises one or more depressions or one or more projections.

(3) The upper member has a substantially planar upper surface which comprises one or more depressions or one or more projections, and the lower member has a planar lower surface which is free from depressions and projections, (4) The upper member has a substantially planar upper surface which comprises one or more depressions, and the lower member has a substantially planar lower surface which comprises one or more depressions.

(5) The horizontal support comprises a depression which does not extend between the upper and lower surfaces.

(6) The upper member comprises a first depression which does not extend between the upper and lower surfaces and the lower member comprises a second depression which does not extend between the upper and lower surfaces, the first and second depressions being coincident when the horizontal support is viewed in plan.

(7) The upper member comprises a first depression and the lower member comprises a second depression, the first and second depressions being coincident when the horizontal support is viewed in plan and communicating with each other, and there is a horizontal lip which lies between the first and second depressions and which extends inwards from the peripheries of the depressions. The horizontal lip prevents a column inserted into either of the depressions from passing through to the opposite side of the support member.

(8) The horizontal support comprises a depression whose periphery is circular or polygonal, for example a hexagon or an octagon, or a rectangle with rounded corners. The depression can have a base which is flat or a base which comprises relatively small irregularities which make it easier for a column placed in the depression to rotate relative to the depression. In some embodiments, the depression has an annular shape when viewed in plan, the outer periphery of the annular shape being circular or polygonal, for example a hexagon or an octagon, and the inner periphery of the annular shape being the same as or different from the shape of the outer periphery. When the depression has an outer periphery which is a circle or a rectangle with rounded corners, it can cooperate with a column having a circular cross-section so that the column can rotate within the depression. Alternatively, the depression can have a shape, for example a rectangle or a polygon, which cooperates with a column having a corresponding shape so that the column cannot rotate in the depression. The depression can also include components that will cooperate with corresponding components on a column, for example twist fit components, so that the column is positively engaged in the depression and cannot be removed without positive measures to disengage the respective components. The use of such components will normally, but not necessarily, result in the column being secured to the support in a way which prevents it from being rotated relative to the support.

(9) The horizontal support comprises a projection whose periphery is circular or polygonal, for example a hexagon or an octagon. When the projection is circular, it can cooperate with a column having a circular periphery so that the column can rotate relative to the support. When the projection is polygonal, it can cooperate with a column having a corresponding periphery so that the column cannot rotate relative to the support; alternatively, it can cooperate with the column having a circular periphery which fits between the innermost surfaces of the polygon.

(10) The upper surface and/or the lower surface comprises a continuous planar surface and one or more projections which are secured to the continuous planar surface, the projections being permanently secured to the continuous planar surface, for example by an adhesive or by welding.

(10) The upper surface and/or the lower surface comprises a continuous planar surface and one or more projections which are removably secured to the continuous planar surface, for example by magnetic or pneumatic forces, said continuous planar surface optionally being provided with markings for locating the one or more removable projections on one or more locations on the continuous planar surface.

(11) Each of the upper and lower surfaces is a continuous planar surface except for any depressions therein.

(12) The upper surface is a continuous planar surface except for the one or more depressions and/or projections, and the lower surface is a continuous planar surface.

(13) The lower surface is a continuous planar surface except for the one or more depressions and/or projections, and the upper surface is a continuous planar surface.

(14) The horizontal support has a uniform thickness, for example a thickness of 1 to 10 inch, e.g. 2 to 5 inch.

(15) The horizontal support has an area, viewed in plan, of 1 to 100 $ft.^2$, for example 4 to 40 $ft.^2$, e.g. 4 to 20 $ft.^2$.

(16) The horizontal support has a volume of at least ½ $ft.^3$, e.g. at least ⅔ $ft.^3$.

(17) The horizontal support has a volume of less than 8 $ft.^3$, e.g. less than 6 $ft.^3$.

(18) The horizontal support has a volume of 1 to 6 $ft.^3$, e.g. at least 1 to 4 $ft.^3$.

(19) At least part of the interior volume of the support is filled with air or another gas.

(20) At least part of the interior volume of the support is filled with a foamed polymeric material having a density which is at most 0.2 times, preferably at most 0.1 times, e.g. 0.01 to 0.1 times, the density of the upper and lower members.

(21) The interior volume of the support is filled with a foamed metallic material having a density which is at most 0.2 times, preferably at most 0.1 times, e.g. 0.01 to 0.1 times, the density of the upper and lower members.

(22) Each of the upper and lower members is composed of a metal, for example aluminum.

(23) Each of the upper and lower members is composed of a polymeric material.

(24) At least part of the support is composed of injection-molded polymeric material.

(24) The interior volume of support comprises one or more ribs which extend between the periphery of the support.

Second Aspect of the Invention

The pedestals of the invention comprise (1) at least one horizontal support according to the first aspect of the invention and (2) at least one vertical column which fits into a depression in the horizontal support or which fits over a projection extending from the horizontal support.

The vertical column can be of any size and shape which enables it to fit into the depression in the horizontal support or to fit over the projection extending from the horizontal support. The column may have a constant cross-section, or the column can have a constant cross-section apart from a terminal portion of different cross-section at one or both ends. The column can have one or more of (i.e. any possible combination of two or more of) the following optional characteristics.

(1) At least part of the column has a constant annular cross-section, when viewed in plan. It may, for example, a tube having one or more sections removed from it to make it lighter and/or easier to handle and/or to enable additional components to be located on the tube.

(2) At least part of the column has a constant annular cross-section when viewed in plan and fits into a depression in the horizontal support which has (a) a cross-section whose periphery is circular and slightly larger than the diameter of the column, in which case the column can rotate in relation to the horizontal support, or (b) a cross-section which is rectangular and preferably has a semicircular ends, with the shorter dimension of the rectangle being slightly larger than the diameter of the column and the rounded corners and the preferable semicircular ends having a diameter slightly larger than the diameter of the column, in which case the column can move both laterally and rotationally in relation to the horizontal support. The column may, for example, be a tube having one or more sections removed from it to make it lighter and/or easier to handle and/or to enable additional components to be located on the tube.

(3) At least part of the column has a constant annular cross-section when viewed in plan, and the column fits over a projection extending from the horizontal support, the projection having a cross-section which is circular with a diameter which is a little less than the diameter of the inner periphery of the annular column, or the projection having a noncircular cross-section which fits within the annular column. In both cases, the column can move rotationally in relation to the horizontal support. The column may, for example, a tube having one or more sections removed from it to make it lighter and/or easier to handle and/or to enable additional components to be located on the tube.

(4) At least one end of the column has a cross-section which is not circular and which is fitted into a depression which is not circular and which prevents the column from rotating in relation to the support.

(5) In some embodiments, the column is no longer than is necessary to provide a connection, for example a rotatable connection, between two support members, i.e. has a length which is substantially equal to the sum of the depths of the recesses in the supports which the column connects (in which case the column is not an important part of the visual appearance of the pedestal). Generally, however, at least one of the columns has a substantial length, for example at least 4 inch, for example 10 to 36 inch. The length of the column can be, for example, from 0.5 to 5 times the effective diameter of the column (the term "effective diameter" being used to denote the diameter of a cylindrical column or, for a non-cylindrical column of constant cross section, the diameter of a circle having the same cross-sectional area as a non-cylindrical column.

The pedestals of the invention can consist essentially of first and second vertical columns and the horizontal support between them. Generally, however, the first and second vertical columns and the horizontal support form part of a larger pedestal. In some embodiments, the pedestal comprises at least one horizontal support which is rotatably connected to at least one column. The pedestal can include a component which fits to a depression or projection on the support member and to the base or the top of a column, and thus forms a connection to a support member and a column which would not otherwise fit together. The height of such a component can be small, e.g. 1-3 inch, for example so that the distance between the support member and the column is minimal.

Some pedestals of the invention comprise a column which extends upwards from the horizontal support and is a hollow tube whose upper periphery comprises at least two pairs, preferably at least four pairs, of open channels into which support members can be fitted, for example as described in U.S. Pat. No. 6,688,573 and U.S. Pat. No. 7,722,005, which are incorporated by reference herein.

Some pedestals of the invention comprise two spaced-apart columns which extend upwards from the horizontal support, and the upper ends of the columns comprise at least two pairs, preferably at least four pairs, of open channels into which support members can be fitted, for example as described in U.S. Pat. No. 7,407,144 which is incorporated by reference herein.

Some pedestals of the invention comprise a first column which has a first axis and which fits rotatably into a recess or over a projection on the lower surface of the support, and a second column which has a second axis and which fits rotatably into a recess or over a projection of the upper surface of the support, the first vertical axis lying within the periphery of the second column, and optionally coinciding with the second vertical axis, for example as described in U.S. Pat. No. 7,673,843, which is incorporated by reference herein.

Some pedestals of the invention comprise (1) a first lower vertical column having a top and a bottom and a first lower vertical axis, (2) a first upper vertical column having a top and a bottom and a first upper vertical axis which is coincident with the first lower vertical axis, (3) a second vertical column having a top and bottom;

(4) a first intermediate horizontal support according to the first aspect of the invention, the top of the first lower vertical column being fitted to a recess or projection in the lower surface of the first horizontal support and the bottom of the first upper vertical being fitted to a recess or projection in the upper surface of the first horizontal support, (5) a second upper horizontal support according to the first aspect of the invention, the top of the first upper vertical column being fitted to a recess or projection in the lower surface of the second horizontal support and the top of the second vertical column being fitted to a recess of projection in the lower surface of the second horizontal support.

Preferably all the connections between the columns and the horizontal supports are rotatable connections The columns used in in the pedestals of the present invention can be the same or different.

A kit comprising components for a plurality of separate pedestal bases, and other components, can be assembled into a wide variety of pedestals of different functionalities, shapes, dimensions and decorative appearances. The invention makes it possible for users to transport a kit of relatively small dimensions to a catering or display event, and to construct, on site, one or more pedestals adapted to the particular requirements of the event. The components are preferably such that, after the event, they can be easily disassembled, cleaned (for example in commercial washing facilities) and repacked as a compact kit for transport to storage or to another event.

The Drawings

Figure 2:
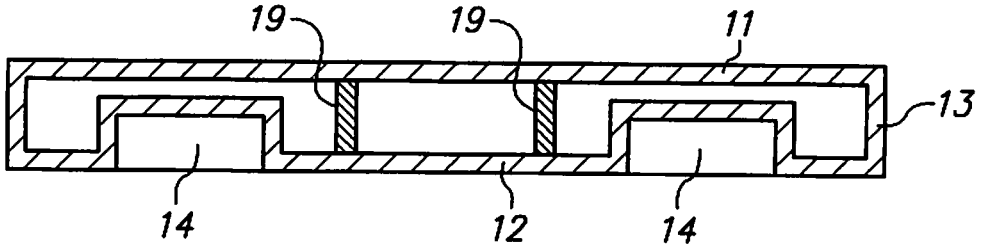
FIG. 2 is a cross-section on line II-II of FIG. 1.
Figure 3:
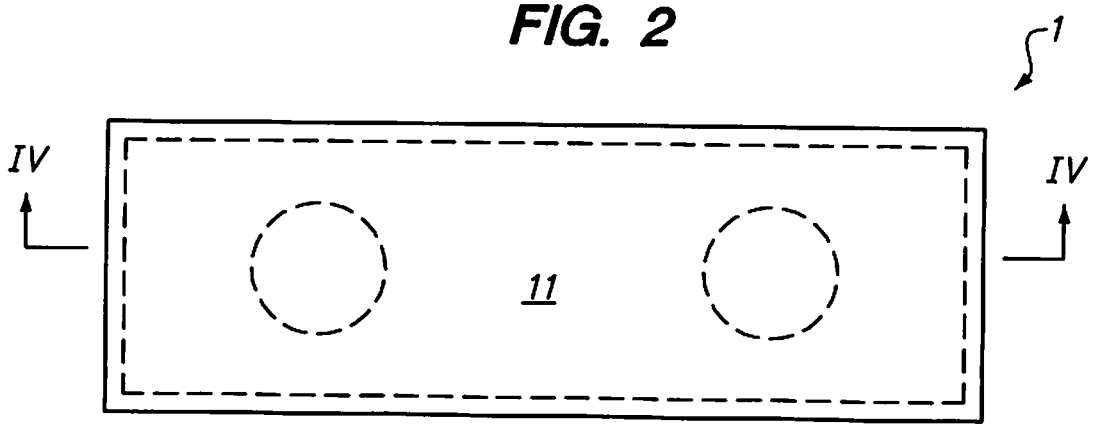
FIG. 3 is a plan view of a horizontal support of the invention.
Figure 4:
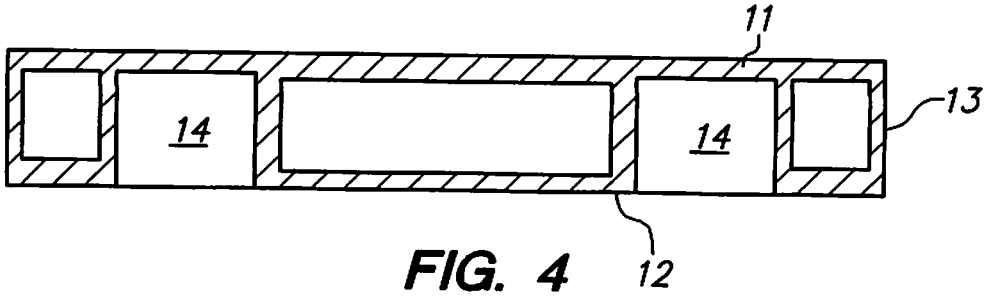
FIG. 4 is a cross-section on line IV-IV of FIG. 3.
Figure 5:
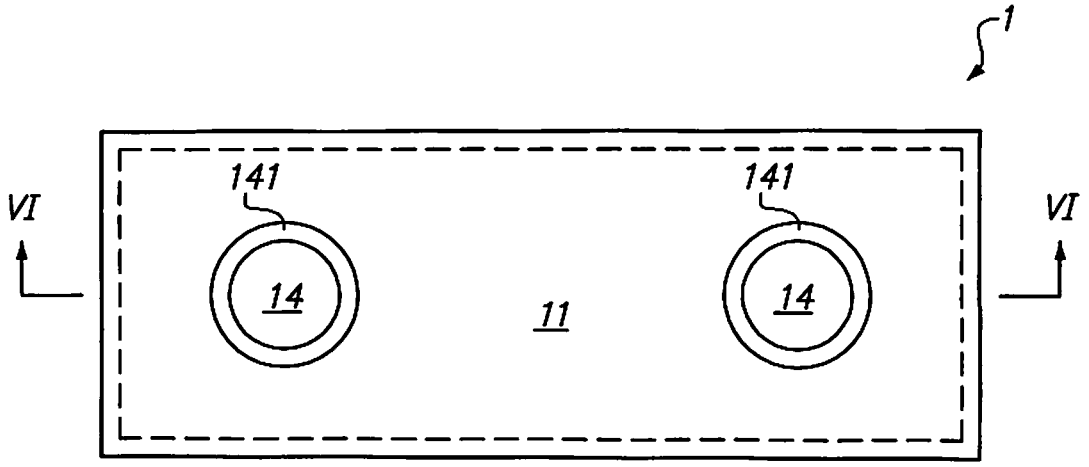
FIG. 5 is a plan view of a horizontal supports of the invention.
Figure 6:
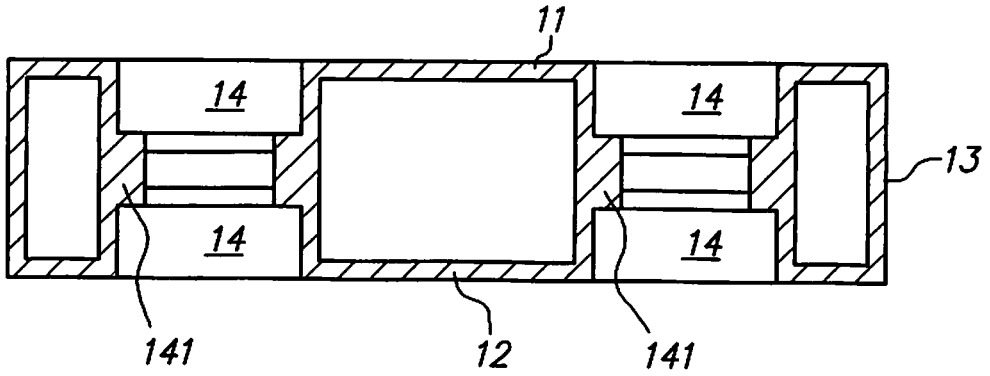
FIG. 6 is a cross-section on line VI-VI of FIG. 5.
Figure 7:
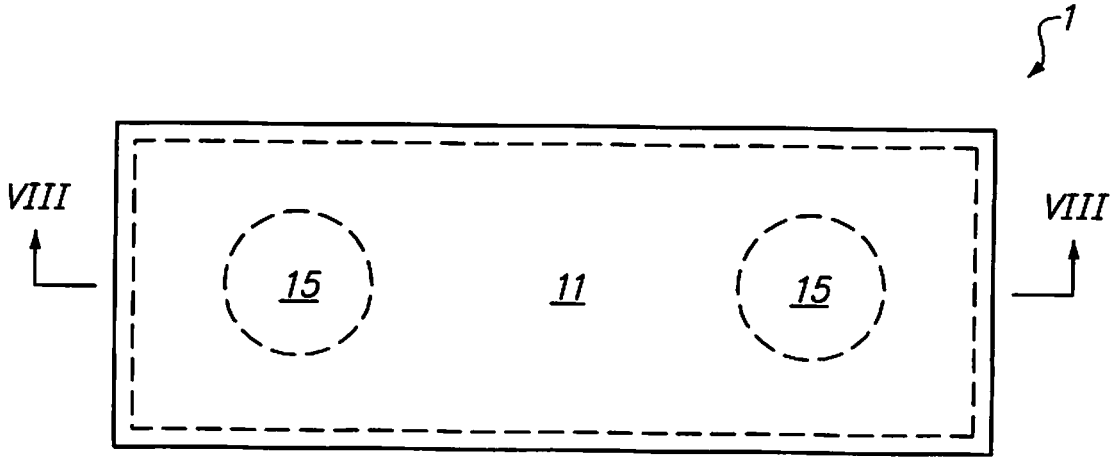
FIG. 7 is a plan view of a horizontal support of the invention.
Figure 8:
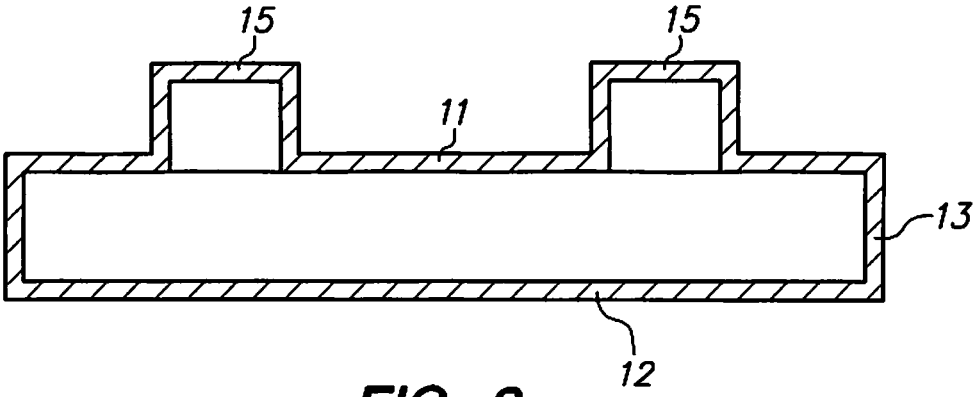
FIG. 8 is a cross-section on line VIII-VIII of FIG. 7.
Figure 9:
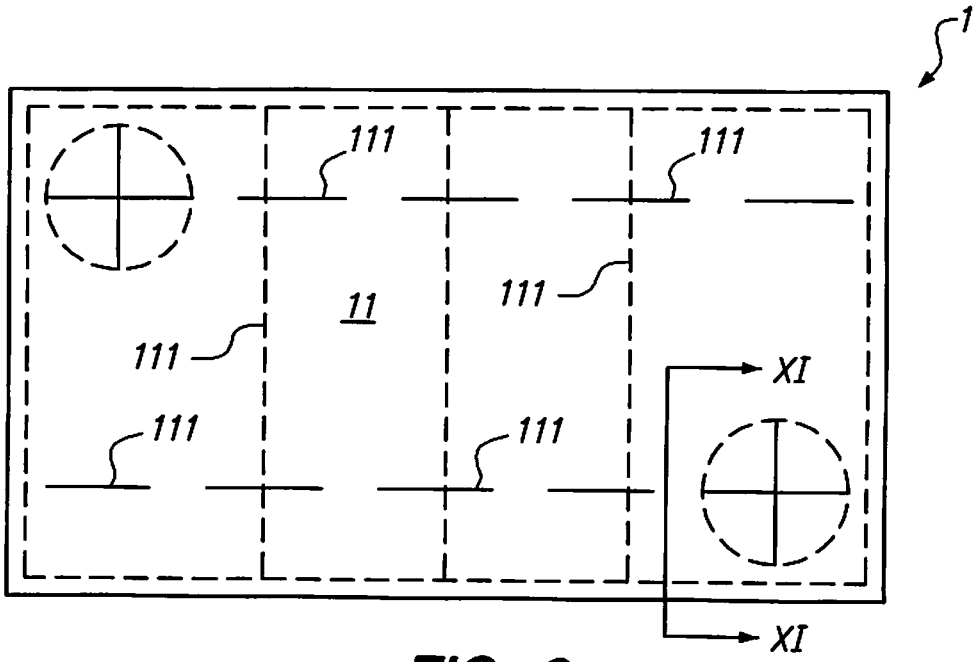
FIG. 9 is a plan view of a horizontal support of the invention.
Figure 10:
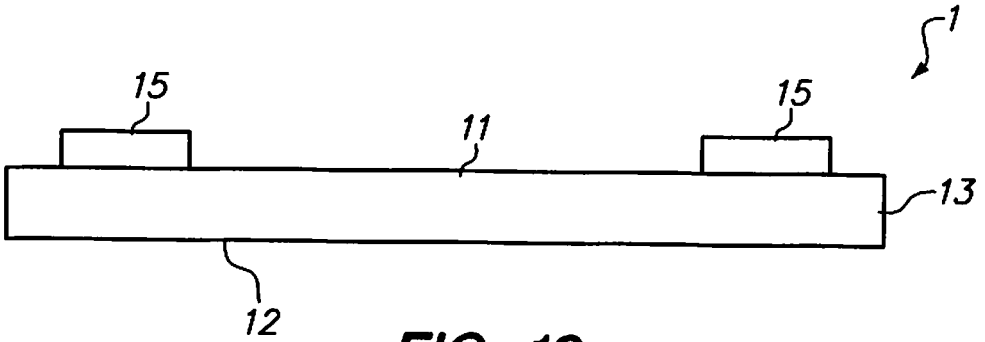
FIG. 10 is a side view of the support of FIG. 9.
Figure 11:
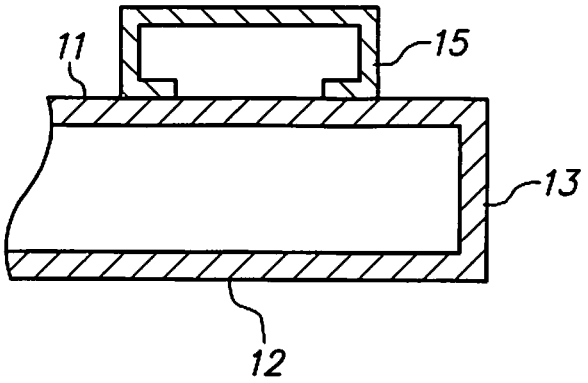
FIG. 11 is a partial cross-sectional view on line XI-XI of FIG. 9.
Figure 12:
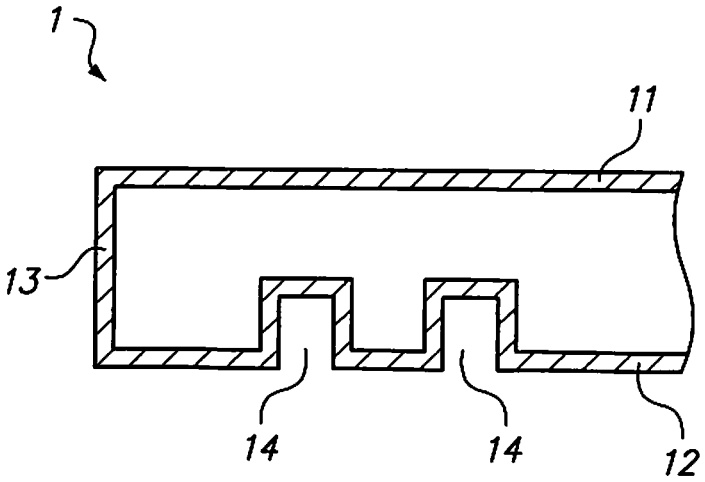
FIG. 12 is a partial cross section of a horizontal support of the invention.

Referring now to the drawings, FIGS. 1-12 show a horizontal support 1 having an upper member 11, a lower member 12 and a peripheral member 13. In FIGS. 1 and 2, reinforcing ribs 19 extend across the hollow space defined by the upper member, lower member and peripheral member. In FIGS. 1, 2, 3, 4 and 12, two depressions 14 extend 14 upwards from the lower member 12. In FIGS. 1, 2, 3 and 4, the depressions have a circular cross-section. In FIG. 12, the depressions have an annular cross-section. In FIGS. 5 and 6, depressions 14 extend upwards from the lower member and coincidently from the upper member, and there is a lip 141 which separates the depressions, and which can support a column placed in the depression. In FIGS. 7, 8, 9 and 10, projections 15 extend upwards from the upper member 11. In FIG. 9, the upper surface of the upper member 11 carries markings 111 in the form of a grid to facilitate the placing of the projections in a desired location on the upper member. The upper surface of the projections carries markings that can be aligned with the markings 111. The projections 15 can be secured permanently by welding or a permanent adhesive, semi-permanently by an adhesive which can be rendered ineffective by a treatment to which the pedestal will not be subject in use, e.g. a hot melt adhesive which can be rendered ineffective by means of a heat gun, or semi-permanently by some other means, for example by pneumatic forces.

Figure 13:
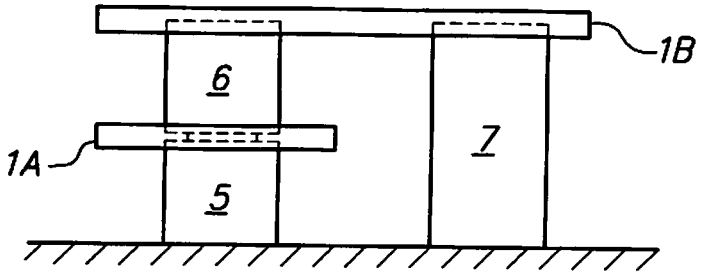
FIG. 13 is a side view and FIG. 14 is a plan view of a pedestal of the invention.
Figure 14:
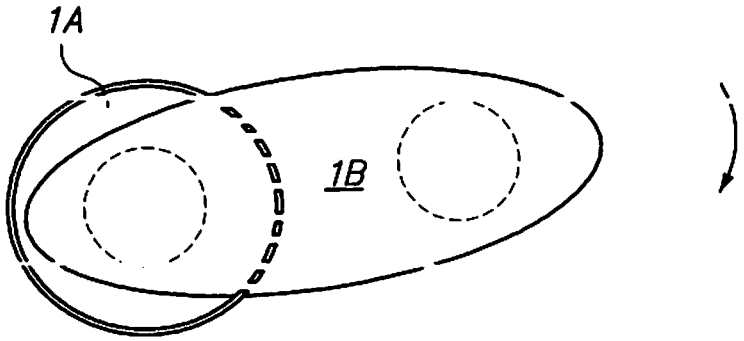

FIGS. 13 and 14 show a pedestal of the invention comprising a circular horizontal support 1A which has a pair of coincident depressions which extend from the upper and lower members respectively and which are separated by a lip as shown in FIG. 6, and a second horizontal support 1B which has an oval shape and which has a pair of spaced apart depressions which extend upwards from the lower member 12 as shown in FIG. 2. A first column 5 is supported on a flat horizontal surface, and its top end is located in the lower depression of the horizontal support 1A. A second column 6 is located in the upper depression of the horizontal support 1A. A third column 7 is placed on the horizontal surface. The tops of the columns 6 and 7 are located in the depressions in the lower surface of the horizontal support 1B. The fittings of the columns to the supports are rotatable, so that the upper horizontal support can be rotated around the columns 5 and 6.

Figure 15:
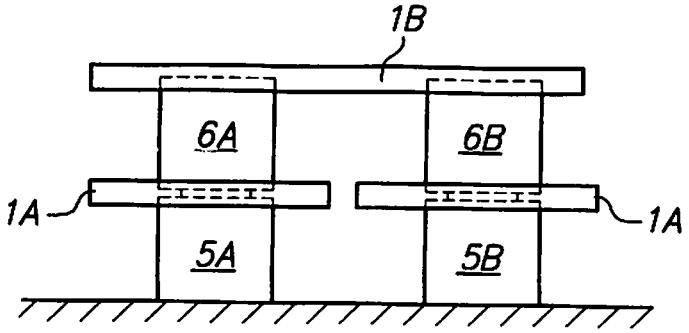
FIG. 15 is a side view of a pedestal of the invention.

FIG. 15 shows a pedestal of the invention which comprises two circular horizontal supports 1A, one of which connects a lower column 5A and an upper column 6A, and the other of which connects a lower column 5B and an upper column 6B. The tops of the column 6A and 6B fit into depressions in the lower surface of horizontal support 1B.

The invention claimed is:

1. A substantially planar support member which is suitable for use as a horizontal support member in a pedestal and which comprises (1) an upper member which has a substantially continuous planar upper surface, (2) a lower member which has a substantially continuous planar lower surface, and (3) a substantially continuous peripheral member which secures the upper and lower, members together, the upper and lower members and the peripheral member defining between them an interior volume which extends over at least part of the area defined by the periphery of the support member, and whose density is substantially smaller than the density of the upper and lower members, and at least one of the upper and lower surfaces comprising a conformation which is selected from the group consisting of (i) depressions which extend inwards from the upper surface or the lower surface but at least part of which does not extend through to the opposite surface and (ii) projections which extend outwards from the upper surface or the lower surface;

wherein the upper member substantially continuous planar upper surface comprises one or more depressions, and the lower member substantially continuous planar lower surface comprises one or more depressions.

2. A support member according to claim 1 wherein the interior volume is filled with air.

3. A support member according to claim 1 which has a uniform thickness of 1 to 10 inch, an area, viewed in plan, of 1 to 100 $ft.^2$ and a volume of at least ½ $ft.^3$.

4. A support member according to claim 1 which has a uniform thickness of 2 to 5 inch, an area, viewed in plan, of 4 to 40 $ft.^2$, and a volume of at least ½ $ft.^3$ and less than 8 $ft.^3$.

5. A support member according to claim 1 having a shape selected from the group consisting of rectangular, rectangular with rounded corners, polygonal, circular, oval and other regularly curved shapes.

6. A support member according to claim 1 wherein at least one of said depressions has a periphery selected from the shapes consisting of circular, annular, polygonal and rectangular with rounded corners.

7. A support member according to claim 1 wherein each of the upper and tower members is composed of a metal.

8. A pedestal which comprises (A) a substantially planar horizontal support member which comprises (1) an upper member which has a substantially continuous planar upper surface, (2) a lower member which has a substantially continuous planar lower surface, and (3) a substantially continuous peripheral member which secures the upper and lower members together, the upper and lower members and the peripheral member defining between them an interior volume which extends over at least part of the area defined by the periphery of the support member, and whose density is substantially smaller than the density of the upper and lower members, and at least one of the upper and lower surfaces comprising a conformation which is selected from the group consisting of (i) depressions which extend inwards from the upper surface or the lower surface but at least part of which does not extend through to the opposite surface and (ii) projections which extend outwards from the upper surface or the lower surface; and (B) a vertical column which fits into one of said depressions in the horizontal support or which fits over one of said projections extending from the horizontal support;

wherein the pedestal comprises a hollow tube which fits rotatably to one of said depressions or one of said projections on said upper surface of the horizontal support member and which comprises at least two pairs of open channels.

9. A pedestal according to claim 8 wherein the support member has a uniform thickness of 2 to 5 inch, an area, viewed in plan, of 4 to 40 $ft.^2$, and a volume of at least ½ $ft.^3$ and less than 8 $ft.^3$; and a shape selected from the group consisting of rectangular, rectangular with rounded corners, polygonal, circular, oval and other regularly curved shape shapes.

10. A pedestal according to claim 8 wherein each of the upper and lower members is composed of a material selected from metals and polymeric materials.

11. A pedestal according to claim 8 which comprises first and second vertical columns each of which is fitted to said horizontal support member.

12. A pedestal which comprises:

(A) a substantially planar horizontal support member which comprises:

(1) an upper member which has a substantially continuous planar upper surface, (2) a lower member which has a substantially continuous planar lower surface, and (3) a substantially continuous peripheral member which secures the upper and lower members together, the upper and lower members and the peripheral member defining between them an interior volume which extends over at least part of the area defined by the periphery of the support member; and whose density is substantially smaller than the density of the upper and lower members, and at least one of the upper and lower surfaces comprising a conformation which is selected from the group consisting of (i) depressions which extend inwards from the upper surface or the lower surface but at least part of which does not extend through to the opposite surface and (ii) projections which extend outwards from the upper surface or the lower surface; and (B) a vertical column which fits into one of said depressions in the horizontal support or which fits over one of said projections extending from the horizontal support;

wherein the pedestal comprises:

(1) a first lower vertical column having a top and a bottom and a first lower vertical axis, (2) a first upper vertical column having a top and a bottom and a first upper vertical axis which is coincident with the first lower vertical axis, and (3) a second vertical column having a top and bottom;

said horizontal support member being a first horizontal support member between said first lower vertical column and said first upper vertical column, the top of the first lower vertical column being fitted to one of said depressions or one of said projections in the lower surface of the first horizontal support member and the bottom of the first upper vertical column being fitted to one of said depressions or one of said projections in the upper surface of the first horizontal support member, and wherein the pedestal further comprises (4) a second horizontal support member having a lower surface with multiple depressions or projections, the top of the first upper vertical column being fitted to one of said multiple depressions or projections in the lower surface of the second horizontal support member and the top of the second vertical column being fitted to one of said multiple depressions or projections in the lower surface of the second horizontal support member.

13. A pedestal according to claim 12 wherein all the connections between the columns and the horizontal support members are rotatable.

* * * * *